US008410344B2

(12) United States Patent
Rovner

(10) Patent No.: US 8,410,344 B2
(45) Date of Patent: Apr. 2, 2013

(54) MOUTHPIECE FOR WOODWIND INSTRUMENTS WITH VENTURI APERTURE

(76) Inventor: Philip Lee Rovner, Timonium, MD (US)

( * ) Notice: Subject to any disclaimer, the term of this patent is extended or adjusted under 35 U.S.C. 154(b) by 18 days.

(21) Appl. No.: 12/971,294

(22) Filed: Dec. 17, 2010

(65) Prior Publication Data

US 2012/0152083 A1 Jun. 21, 2012

(51) Int. Cl.
*G10D 9/00* (2006.01)

(52) U.S. Cl. ..... 84/383 R

(58) Field of Classification Search ..... 84/383 R; 83/383 R; D17/13
See application file for complete search history.

(56) References Cited

U.S. PATENT DOCUMENTS

| | | | | |
|---|---|---|---|---|
| 1,771,157 | A | | 7/1930 | Arthur |
| 2,368,556 | A | | 1/1945 | MacCaferri |
| 2,411,692 | A | | 11/1946 | Murano |
| 2,499,855 | A | | 3/1950 | Gamble |
| 2,517,077 | A | | 8/1950 | Berry |
| 2,525,523 | A | * | 10/1950 | Chance ..... 84/383 R |
| 3,150,554 | A | | 9/1964 | Leloup |
| 3,433,113 | A | | 3/1969 | Portnoy |
| 3,521,517 | A | | 7/1970 | Fusao |
| 3,905,268 | A | | 9/1975 | Gamble |
| 4,056,997 | A | | 11/1977 | Rovner |
| 4,210,055 | A | | 7/1980 | Platamone, Jr. |
| 4,308,781 | A | | 1/1982 | McGuerty |
| 4,428,271 | A | | 1/1984 | Winslow et al. |
| 4,449,439 | A | | 5/1984 | Wells |
| 4,517,875 | A | | 5/1985 | Dossekker |
| 5,018,425 | A | | 5/1991 | Rovner |
| 5,105,701 | A | | 4/1992 | Hall et al. |
| 5,192,821 | A | | 3/1993 | Goldstein et al. |
| 5,289,752 | A | | 3/1994 | Barbaglia |
| 5,293,805 | A | | 3/1994 | Guardala et al. |
| 5,303,628 | A | | 4/1994 | Salazar |
| 5,357,837 | A | | 10/1994 | Disera |
| 5,398,582 | A | | 3/1995 | Smith |
| 5,419,229 | A | | 5/1995 | Van Doren |
| 5,456,152 | A | | 10/1995 | Cusack et al. |
| 5,623,111 | A | | 4/1997 | Van Doren et al. |
| 5,728,957 | A | | 3/1998 | Valtchev |
| D404,755 | S | | 1/1999 | Garbuzov |
| 5,973,245 | A | | 10/1999 | Van Doren |
| 5,998,715 | A | | 12/1999 | Rovner |

(Continued)

OTHER PUBLICATIONS

Passband, http://www.absoluteastronomy.com/topics/Passband viewed Mar. 17, 2011.

*Primary Examiner* — Jianchun Qin
(74) *Attorney, Agent, or Firm* — August Law, LLC; George Willinghan

(57) ABSTRACT

An improved mouthpiece for use with single reed woodwind instruments is provided. The mouthpiece includes a tapered shaped tone chamber that creates shaped-charge dynamics in the tone chamber air column to improve coupling of the air column to the reed. The tapered shape is obtained by varying the width of the tone chamber along the interior surfaces of the side walls from a top surface of the side rails to the bottom surface of the tone chamber. In addition, the width of the bottom surface is varied along a length of the tone chamber from a tip rail to the central bore of the mouthpiece. The transition from the top surfaces of the side rails to the interior surface of the tone chamber side walls is sloped to achieve a venturi effect between the top surfaces and the reed at the region of the tone chamber adjacent the tip rail.

14 Claims, 4 Drawing Sheets

U.S. PATENT DOCUMENTS

| | | | | |
|---|---|---|---|---|
| 6,020,545 | A | 2/2000 | Consoli | |
| 6,118,060 | A | 9/2000 | Van Doren | |
| 6,130,376 | A | 10/2000 | Chang | |
| 6,150,593 | A | 11/2000 | Holden | |
| 6,673,992 | B1 | 1/2004 | Runyan | |
| 7,169,993 | B2 | 1/2007 | Fliegel et al. | |
| 7,326,840 | B2 | 2/2008 | Wanne | |
| 7,465,864 | B2 | 12/2008 | Heintz | |
| 7,470,844 | B2 | 12/2008 | Espina | |
| 7,626,105 | B2 * | 12/2009 | Rovner | 84/383 R |
| 7,667,118 | B1 | 2/2010 | Behn | |
| 7,863,509 | B2 | 1/2011 | Rovner | |
| 2004/0011183 | A1 | 1/2004 | Fliegel et al. | |
| 2005/0061136 | A1 | 3/2005 | Rovner | |
| 2005/0072623 | A1 | 4/2005 | Rovner | |
| 2005/0087057 | A1 | 4/2005 | Taillard | |
| 2006/0272473 | A1 | 12/2006 | Kuo | |
| 2008/0022839 | A1 | 1/2008 | Sullivan | |
| 2009/0217798 | A1 | 9/2009 | Rovner | |
| 2009/0217800 | A1 | 9/2009 | Rovner | |
| 2010/0043621 | A1 | 2/2010 | Rovner | |

* cited by examiner

MOUTHPIECE FOR WOODWIND INSTRUMENTS WITH VENTURI APERTURE

FIELD OF THE INVENTION

The present invention relates to woodwind instruments and in particular to mouthpieces for woodwind instruments.

BACKGROUND OF THE INVENTION

Woodwind musical instruments, e.g., saxophones and clarinets, and other devices such as bird calls, utilize the vibration of a reed in response to a flow of air to generate a tone. These reeds include natural cane reeds and synthetic reeds. Tone generation in general depends on proper reed vibration. The reed is typically placed in contact with a mouthpiece to cover an opening or window. The reed is held in place by an adjustable clamp or ligature that surrounds the mouthpiece and the reed. Variations in the mouthpiece and ligature affect the vibration of the reed and, therefore, the performance or tone of the device or instrument.

The essential function of the mouthpiece of a woodwind instrument is to provide support for the reed over an aperture that allows the reed to vibrate and to direct the energy from the reed vibration through the aperture and into the bore of the instrument. The function and performance of a mouthpiece is influenced by the arrangement and geometry of the facing around the aperture as well as tone chamber below the reed which defines the route from the aperture to the bore. The facing is conventionally a flat surface on the mouthpiece surrounding the aperture, and the reed is placed in contact with this flat surface, covering the aperture. The facing includes the aperture, called a window, and the window is surrounded by a table on one end, two side rails extending from the table and a tip rail opposite the table. The reed functions as a reed valve during vibration, opening and closing the window.

In conventional mouthpieces, the reed is affixed tightly against the flat portion of the facing to secure the mounting of the reed and to affect an airtight seal of the reed with the mouthpiece. In addition, the top surfaces of the side rails that are in contact with the reed are flat. The tone chamber is conventionally formed as a rectangular box having straight interior walls and a flat generally rectangular bottom surface. The transitions from the top surfaces to the interior walls and from the interior walls to the bottom surface are right angles.

SUMMARY OF THE INVENTION

The present invention is directed to mouthpieces yielding increased performance in woodwind instruments through improvements in the interface between the reed and the mouthpiece and improvements in the shape of the tone chamber. These improvements include changes to the interface between the window and the mouthpiece bore, modification to the shape of the portions of the side and tip rails that are in contact with the reed and improvements in the shape of the interior surfaces of the side rails and the bottom surface of the tone chamber. Contouring the top surfaces of the side and tip rails to induce a smoother airflow during that period of the oscillatory cycle when the reed is about to complete the closure of the window significantly improves performance of the mouthpiece. The tops of the side and tip rails can include a curvature that allows the reed to function as a reed valve during operation of the instrument. Alternatively, the angle between the top surface of the side rail and the interior surface is increased to greater than 90°, for example, by slanting or curving the interior surface of the side walls of the tone chamber. The bottom surface of the tone chamber can also be configured to vary in width from the tip rail of the mouthpiece to the interior bore.

Based on the shape of the tone chamber and side rail top surface transitions to the interior surfaces, the improved single-reed woodwind mouthpieces of the present invention utilize a tone chamber having a triangular or conical cross section in combination with a triangular or conical shaped bottom surface. This yields a conical shaped tone chamber having its widest end adjacent the tip rail of the mouth piece and narrowing along the length of the tone chamber to the central bore of the mouthpiece. These shape modifications improve energy flow through the apertures between the side rails and the reed, improve the coupling of the reed to the air column in the tone chamber and intensify the harmonic content of the tone produced by the mouthpiece. The conical shape of the tone chamber applies shaped-charge dynamics to the air column in the tone chamber. The shaped-charge dynamics improve the coupling of the air column in the tone chamber to the reed.

In accordance with one exemplary embodiment, the present invention provides a woodwind mouthpiece containing a central bore passing through the mouthpiece and a tone chamber in communication with the central bore and having a bottom surface. A window, i.e., opening, is provided to expose the tone chamber. The mouthpiece includes a pair of side rails extending along opposite sides of the window. Each side rail includes a side rail top surface and an interior surface, i.e., interior to the tone chamber, running from the top surface of the side rail to the bottom surface of the tone chamber. In one embodiment, each top surface and associated sidewall meets at an angle of greater than 90°. The mouthpiece also includes a tip rail extending between the side rails. The tone chamber extends from the tip rail to the central bore.

A tone chamber width is defined by a distance between the interior surfaces of the side rails and is greater at the side rail top surface than at the bottom surface of the tone chamber. In one embodiment, the tone chamber width is greater at the side rail top surface than at the bottom surface of the tone chamber along an entire length of the tone chamber from the tip rail to the central bore. Alternatively, the tone chamber width is greater at the side rail top surface than at the bottom surface of the tone chamber along only a portion of the entire length of the tone chamber from the tip rail to the central bore. In one embodiment, the tone chamber width includes a first width at points of intersection of the top surfaces and the interior surfaces of the side rail and a second width at points of intersection of the interior surfaces of the side rail and the bottom surface of the tone chamber. The ratio of the second width to the first width is about 0.3. In another embodiment, the ratio of the second width to the first width varies from about 1 to about 0.3 along the length of the tone chamber from the tip rail to the central bore. In one embodiment, this variation in the ratio of the second width to the first width occurs along only a portion of a length of the tone chamber from the tip rail to the central bore. This portion of the length is from about ¼ to about ½ of the length of the tone chamber.

A tone chamber bottom surface width is defined by a distance between the interior surfaces of the side rails at the bottom surface and is greater at an end of the tone chamber adjacent the tip rail than at an end of the tone chamber adjacent the central bore. In one embodiment, the bottom surface width includes a first width at a point of intersection of the side rail and the tip rail and a second width at a point of intersection of the tone chamber and the central bore. The ratio of the second width to the first width is from about 0.8 to about 0.1. In one embodiment, the second width extends along a portion of the length of the bottom surface starting at a point between the tip rail and the central bore. The point as measured from the tip rail is disposed from about ¼ to about ½ along the length of the bottom surface. In one embodiment, the second width extends from the point between the tip rail and the central bore along the tone chamber to the central bore.

Overall, the tone chamber has a tapered or triangular cross section from side rail to side rail and the bottom surface has a tapered or conical shape with a wider portion of that conical shaped disposed adjacent the tip rail. In one embodiment, this conical shape extends along the bottom surface from the tip rail a distance of from about ¼ to about ½ of the length of the bottom surface. This produces a tone chamber with sides or side walls that taper or slope when moving from the top to the bottom of the tone chamber as well as when moving from the tip rail to the table, yielding an overall, three-dimensional shape that is generally conically or pyramidal. This yields a shaped-charge type geometry in the tone chamber when viewed from the tip rail. Alternatively, the tone chamber can be formed as a linear shaped charge that has a generally consistent shape or taper along the length of the tone chamber from tip rail to table. In yet another embodiment, combinations of the three-dimensional conical or pyramidal shape and the linear shaped charge arrangement for the tone chamber are provided. For example, a conical arrangement is provided adjacent the tip rail, and this arrangement blends into a linear, triangular or sloped cross-section when moving along the length of the tone chamber from the tip rail.

The present invention is also directed to a woodwind mouthpiece having a central bore passing through the mouthpiece, a tone chamber in communication with the central bore and a window exposing the tone chamber. A pair of side rails extends along opposite sides of the window. Each side rail includes a side rail top surface and an interior surface running from its top surface to the bottom surface of the tone chamber. The mouthpiece also includes a tip rail extending between the side rails. The tone chamber extends from the tip rail to the central bore. The tone chamber has a tapered, triangular or conical cross section from side rail to side rail, and the bottom surface has a tapered, triangular or conical shape having a wider portion adjacent the tip rail. In one embodiment, the conical shape extends along the bottom surface from the tip rail a distance that is from about ¼ to about ½ of the length of the bottom surface.

The present invention is also directed to a method for creating a woodwind mouthpiece by forming a central bore passing through the mouthpiece and a tone chamber in communication with the central bore. The tone chamber includes a bottom surface and a pair of opposing interior surfaces extending from the bottom surface. A window is also formed in communication with the tone chamber to expose the tone chamber. The interior surfaces and the bottom surface of the tone chamber are shaped to create shaped-charge dynamics in an air column within the tone chamber to increase coupling of the air column to a reed covering the window. In one embodiment, the interior surfaces are formed to create a conical cross section as viewed across the opposing interior surface, and the bottom surface is formed to create a conical shape. The method also includes forming a tip rail in the mouthpiece at an end of the tone chamber opposite the central bore such that formation of the bottom surface to create a conical shape includes forming a wider portion of the conical shape adjacent the tip rail.

DETAILED DESCRIPTION

Exemplary embodiments of mouthpieces for woodwind musical instruments and other suitable devices manipulate the venturi effect at the aperture between the mouthpiece window and the reed and utilize shaped-charge dynamics, or the Monroe Effect, within the tone chamber portion of the mouthpiece to yield a mouthpiece having substantially increased power, better intonation and greater ease of playing than conventional mouthpieces. As used herein, shaped-charge dynamics refers to the hydrodynamic or aerodynamic effects and the physics associated with those effects that are employed in the field of shaped charges. It is known that a conical or triangular cavity in an explosive charge will cause the generation of extremely high energy shock waves to form a jet capable of penetrating thick armor steel. The merging of the shock fronts due to the angularity of the adjacent walls of the cavity creates very intense jets of energy along the centerline of the apex of the cone or triangle. The present invention applies this phenomenon to woodwind mouthpieces to increase the coupling of the reed to the air column in the tone chamber of the mouthpiece. This conical tone chamber configuration is also combined with sloping interior surfaces of the tone chamber sidewalls from the top surfaces of the side rails and sloping transitions from the side rails to the tip rail of the mouthpiece. Therefore, energy flow is improved through the aperture between the reed and the side rails in particular near the tip rail.

Figure 1:
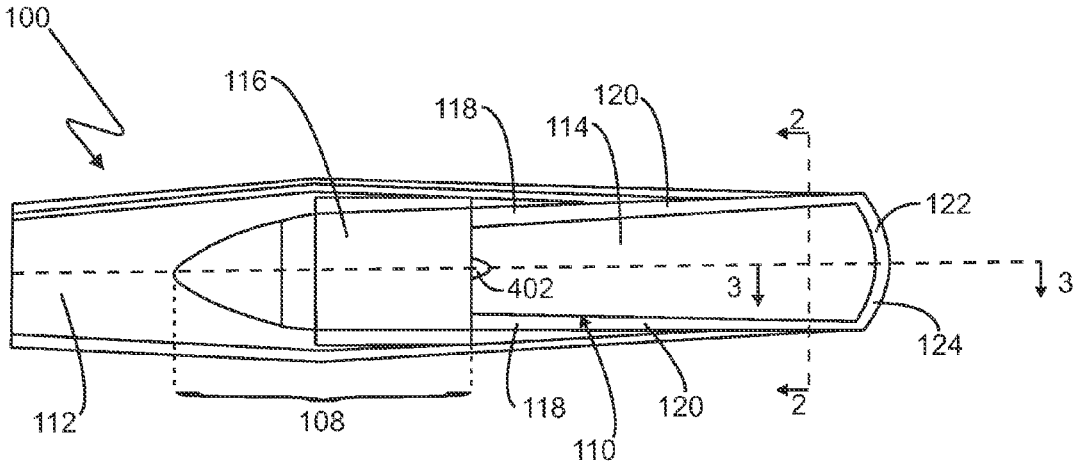
FIG. 1 is a plan view of a bottom side of an embodiment of a mouthpiece in accordance with the present invention.

Referring initially to FIG. 1, an exemplary embodiment of a mouthpiece 100 having a rectangular tone chamber and a modified side rail top surface and tip rail in accordance with the present invention is illustrated. The illustrated embodiment of the mouthpiece 100, as well as the other illustrated embodiments of mouthpieces, is for use with a single reed woodwind instrument, for example a clarinet or saxophone. In general, the mouthpiece is arranged to support a reed that is secured to the mouthpiece with a ligature. Suitable arrangements of reeds and ligatures are known and available in the art. In one embodiment, the mouthpiece has a typically elongated or barrel shape that tapers to either end. On a bottom side 112 of the mouthpiece is an elongated window 110 having a generally rectangular shape. The window may be tapered or narrow at one end or the other. In addition, one end of the window can include a bow or arch to match or compliment the curvature of the end of the reed. The side of the mouthpiece containing the window is considered the bottom side, because that side typically faces down or is on the bottom of the mouthpiece when the mouthpiece is attached to a musical instrument. For purposes of the present description, each mouthpiece is viewed in an inverted orientation.

The window 110 exposes a tone chamber 114 within the mouthpiece. In one embodiment, the tone chamber has a rectangular cross section when view across the side rails of the mouthpiece. Preferably, the tone chamber has a conical shape as described below. The tone chamber is in communication with a central bore 402 passing through the mouthpiece. The central bore is arranged to attach to the woodwind instrument. In one embodiment, the central bore meets the tone chamber at one end of the window, i.e., the central bore does not extend into the portion of the mouthpiece exposed by the window. Alternatively, the central bore extends into the portion of the mouthpiece exposed by the window.

In general, the mouthpiece includes a tapered, reduced rear portion that is adapted to fit to the woodwind instrument in a conventional manner. The central bore has a length necessary to telescopically receive a neckpiece of the woodwind instrument. In one embodiment, the central bore is cylindrical. A table 108 is disposed at one end of the window. The table is a flat surface on the bottom side of the mouthpiece and is situated to engage a portion of a reed adjacent the heel end of the reed. This flat surface is the top 116 of the table, and the top engages the portion of the reed adjacent the heel end of the reed. The ligature securing the reed to the mouthpiece surrounds the mouthpiece around the table region of the mouthpiece. In one embodiment, the table has an overall length of about 1.9375" to about 2".

The mouthpiece also includes a pair of side rails 118 running along opposite sides of the window 110. Each side rail 118 frames one side of the window 110. The side rails 118 extend from the table 108. In one embodiment, the side rails extend perpendicularly from the table. Alternatively, the side rails flare outwards as they extend from the table. The side rails are parallel in that the side rails do not cross or intersect in the region of the window. Each side rail includes a side rail top surface 120 running along the length of the side rail. The top surface of each side rail contacts a portion of the reed. In one embodiment, each side rail has a length of about 2" to about 2.125", and each side rail top surface has a width of about 0.0625" to about 0.125". In one embodiment, the width of each side rail top surface varies from about 0.125" at the table to about 0.0625" at the other end of the side rail. In one embodiment, each side rail top surface is coplanar with the table top. Alternatively, each side rail top surface is coplanar with the table top at the point of intersection of the side rail with the table top and subsequently curves away from the plane of the table top in the direction of the top side 202 (FIG. 2) of the mouthpiece. The top side 202 of the mouthpiece is opposite the bottom side 112. This curvature provides for separation between the reed and the side rail top surfaces at an end of the reed opposite the heel end. This separation occurs, for example, when the reed is attached to the mouthpiece and is not vibrating. Vibration of the reed causes the reed to come into contact with the side rail top surfaces along the entire length of the top rails. The reed in combination with the window acts as a valve for the tone chamber.

The mouthpiece also includes a tip rail 122. The tip rail extends between the side rails at an end of the window opposite the table. In one embodiment, the tip rail extends along a generally straight line between the side rails. Preferably, the tip rail follows an outward arc between the side rails. The tip rail is in contact with the reed when the reed vibrates to close the window in the tone chamber. In one embodiment, the tip rail spans a distance between the side rails of from about 0.625 inches to about 0.75 inches. The shape of the tip rail can be the same as the shape of the tip of the reed or can be an arc having a different curvature than the tip of the reed. The tip rail includes a tip rail top surface 124. The tip rail top surface is the portion of the tip rail that comes onto contact with the reed. In one embodiment, the tip rail top surface has a width of up to about 0.0625 inches. In one embodiment, the tip rail top surface is coplanar with the side rail top surfaces at the points of intersection between the side rails and the tip rail.

Figure 2:
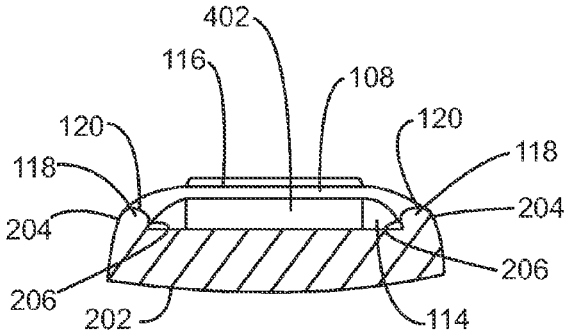
FIG. 2 is a view through line 2-2 of FIG. 1 with the bottom side facing upwards.

Referring to FIG. 2, in one embodiment, the top surface 120 of each side rail 118 includes a rounded transition from at least one of an interior surface 206 of that side rail to the side rail top surface 120 and an exterior surface 204 of that side rail to the side rail top surface. The interior surfaces of the side rails form the side walls of the tone chamber and the exterior surfaces are part of the exterior of the mouthpiece. In this embodiment, both the interior and exterior corners of the top surfaces of the side rails are rounded. Therefore, each side rail top surface comprises a convex surface. The rounded transitions extend at least partially along the top surface of each side rail, from the tip rail to the table. The portions of the side rail top surface that are not rounded are substantially flat. In one embodiment, each rounded portion of the side rail top surface extends from a point of intersection of that side rail with the tip rail partially along the side rail top surface toward the table. Rounding of the transition from the top to the side of the side rails to form the rounded or convex shape eliminates sharp edges and flat surfaces. In addition, the amount of side rail top surface in contact with the reed is reduced. During the negative pressure portion of the oscillatory cycle of the reed, when the reed is being drawn towards closure, i.e., into contact with the side rail top surfaces, the rounded surfaces effect a venturi, reducing airflow turbulence and resulting in a more liquid, less gritty tonal quality. In addition, an improvement in response, intonation, and tonal size is produced.

Figure 3:
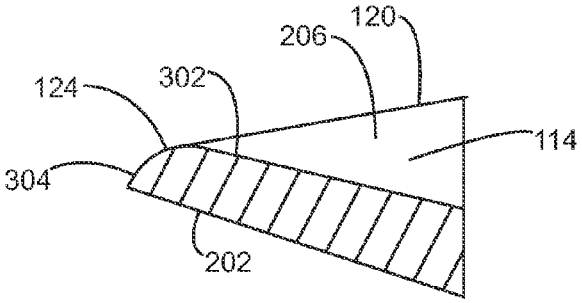
FIG. 3 is a view through line 3-3 of FIG. 1 with the bottom side facing upwards.

Referring to FIG. 3, in one embodiment, the top surface 124 of the tip rail includes a rounded transition from at least one of an interior surface 302 of the tip rail to the tip rail top surface 124 and an exterior surface 304 of the tip rail, i.e., the end of the mouthpiece, to the tip rail top surface 124. In one embodiment, the exterior rounded transition can continue all the way to the top side 202 of the mouthpiece. In one embodiment, the tip rail rounded transition extends completely along the tip rail from one side rail to the other side rail. In one embodiment, the tip rail top surface is a convex surface. The rounded tip rail top surface provides the same benefits as the rounded side rail top surfaces.

Figure 4:
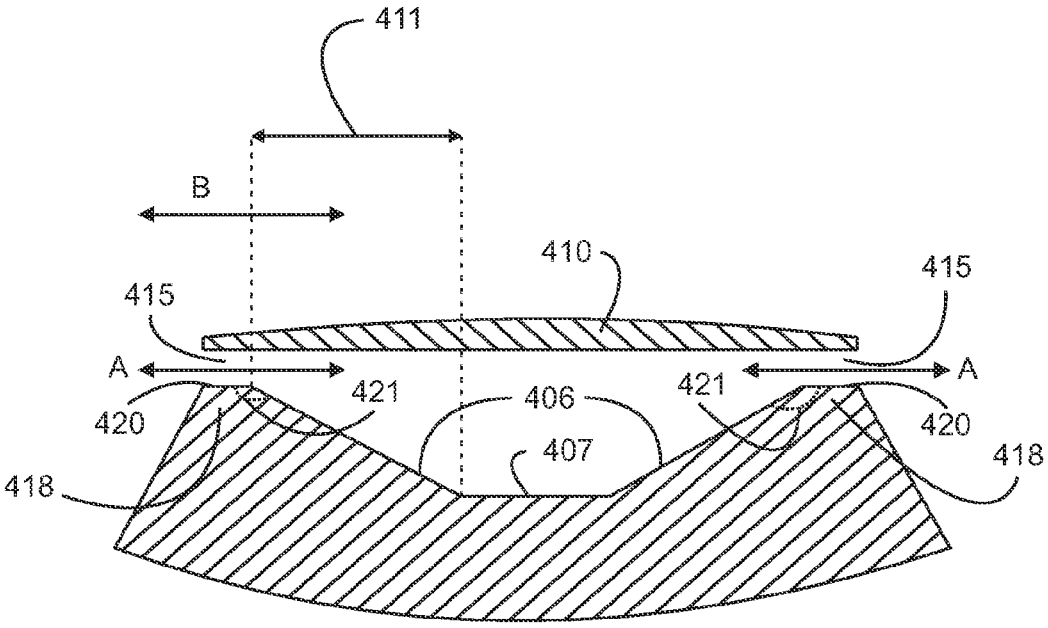
FIG. 4 is a representation of an alternative embodiment of sloping tone chamber sidewalls in a mouthpiece in accordance with the present invention.

Referring to FIG. 4, in another embodiment, the top surface 420 of each side rail 418 is flat. The interior surface 406 of each side rail is slanted or sloped from the top surface 420 to the bottom surface 407 of the tone chamber. Although illustrated as an angled straight line, the interior surface can also have a convex or concave curvature. Other curvatures including compound curves can also be used. Therefore, as illustrated, the cross section of the tone chamber from side rail to side rail is not rectangular but is triangular or conical. The amount of slope can be constant and can extend along the entire length of the tone chamber from top rail to central bore. Alternatively, the sloped interior surfaces of the side rails extend only partially along the length of the tone chamber. The amount of slant of each interior surface can be constant along its entire length or can be varied along its length. In general, the slope of the interior surface defines an angle 421 between the side rail top surface 420 and the interior surface 406 that is greater than about 90°. In one embodiment, the sloped interior surface is combined with at least one of rounded interior and exterior corners of the top surfaces of the side rails as described above. The sloping interior surface in combination with the flat top surface, defines an aperture 415 between each side rail and the reed 410 that is attached to the mouthpiece. Oscillating airflow passes through the apertures as indicated by arrows A. During the negative pressure portion of the oscillatory cycle of the reed, when the reed is being drawn towards closure, i.e., into contact with the side rail top surfaces, the sloping interior surfaces effect a venturi, reducing airflow turbulence along the oscillatory airflow and resulting in a more liquid, less gritty tonal quality. In addition, the amount of reflection as indicated by arrow B from the edges of the reed 410 into the transitional impedance area 411 of the reed is reduced.

Referring to FIGS. 5-9, an exemplary embodiment of a woodwind mouthpiece 500 having a conical shaped tone chamber in accordance with the present invention is illustrated. The mouthpiece 500 includes a central bore 504 passing through the mouthpiece and a tone chamber 514 in communication with the central bore 504. The tone chamber includes a bottom surface 523. A window 510 is provided on a bottom surface 512 of the mouthpiece to expose the tone chamber 514. In one embodiment, the central bore does not extend past the window. In another embodiment, the central bore extends past the window and into the tone chamber. A pair of side rails 518 extends along opposite sides of the window from a table 508 at one end to a tip rail 522 at the other end. Each side rail 518 includes a side rail top surface 520 and an interior surface 521 that runs from the top surface 520 to the bottom surface 523 of the tone chamber 514. In one embodiment, each top surface and associated interior surface or sidewall meets at an angle of greater than 90°. The tip rail 522 extends between two points of contact 525 with the side rails 518, and the tone chamber 514 extends from the tip rail 522 to the central bore 504. This defines a length 526 of the tone chamber bottom surface 523. The tip rail also defines one end of the window, and the window 510 also has a length 527 running parallel to the length of the bottom surface. These two lengths can be equal, or one length can be greater than the other length. In one embodiment, the window length 527 is greater than the bottom surface length 526. Suitable lengths include, but are not limited to, about 1.125 inches to about 1.625 inches.

The tone chamber has a width 528 defined by a distance across the length of the window between the interior surfaces of the side rails. As the interior walls are sloped, this width varies along the interior surfaces from the top surface of the side rails to the bottom surface of the tone chamber. In one embodiment, the tone chamber width is greater at the side rail top surface than at the bottom surface of the tone chamber. For example, the width can vary from about 0.4375 inches to about 0.0625 inches or from about 0.5 inches to about 0.125 inches. In one embodiment, the tone chamber width is greater at the side rail top surface than at the bottom surface of the tone chamber along an entire length 526 of the tone chamber from the tip rail to the central bore. Alternatively, the tone chamber width is greater at the side rail top surface than at the bottom surface of the tone chamber along only a portion of the length of the tone chamber from the tip rail to the central bore.

Figure 8:
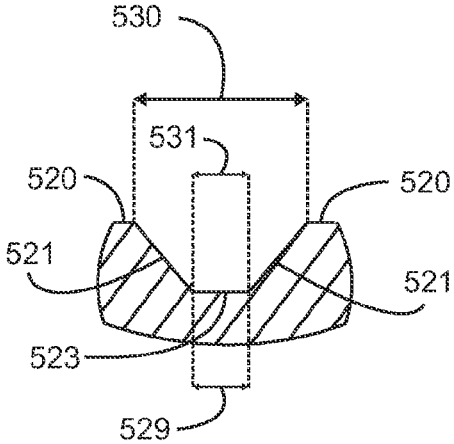
FIG. 8 is a view through line 8-8 of FIG. 5 with the bottom side facing upwards.
Figure 9:
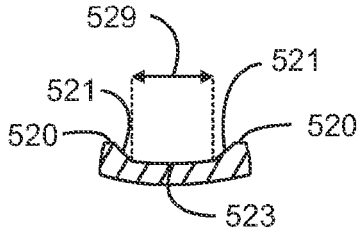
FIG. 9 is a view through line 9-9 of FIG. 5 with the bottom side facing upwards.

As illustrated in FIG. 8, the tone chamber width includes a first width 530 defined at the points of intersection of the top surfaces and the interior surfaces of the side rails and a second width 531 at the points of intersection of the interior surfaces of the side rails and the bottom surface of the tone chamber. Suitable first widths include, but are not limited to, from about 0.375 inches to about 0.625 inches. Suitable second widths include, but are not limited to, from about 0.0625 inches to about 0.625 inches. In one embodiment, the ratio of the second width to the first width is about 0.3. This ratio can be constant along the length of the tone chamber or can be varied along the length of the tone chamber. In one embodiment, the ratio of the second width to the first width varies from about 1 to about 0.3 from the tip rail to the central bore. When the ratio of the second width to the first width varies, it can vary continuously along the length of the tone chamber or can vary only along portions of the length, being constant in the other portions. For example, the ratio is varied only along a portion of a length of the tone chamber from the tip rail to the central bore. In one embodiment, the portion of the length is from about ¼ to about ½ of the length of the window or tone chamber.

The mouthpiece also includes a bottom surface width 529 (FIGS. 8 and 9) defined by a distance between the interior surfaces of the side rails at the bottom surface. This bottom surface width can be constant along the length 526 of the tone chamber or window or can vary along the length of the tone chamber or window. Suitable widths for the bottom surface include, but are not limited to, from about 0.0625 includes to about 0.625 inches. In one embodiment, the interior surfaces slope down and meet either at an angle or curve. In this embodiment, the bottom surface is eliminated and replaced by the intersection of the opposing interior surfaces. In one embodiment, the bottom surface width 529 is greater at an end of the tone chamber adjacent the tip rail than at an end of the tone chamber adjacent the central bore.

Figure 5:
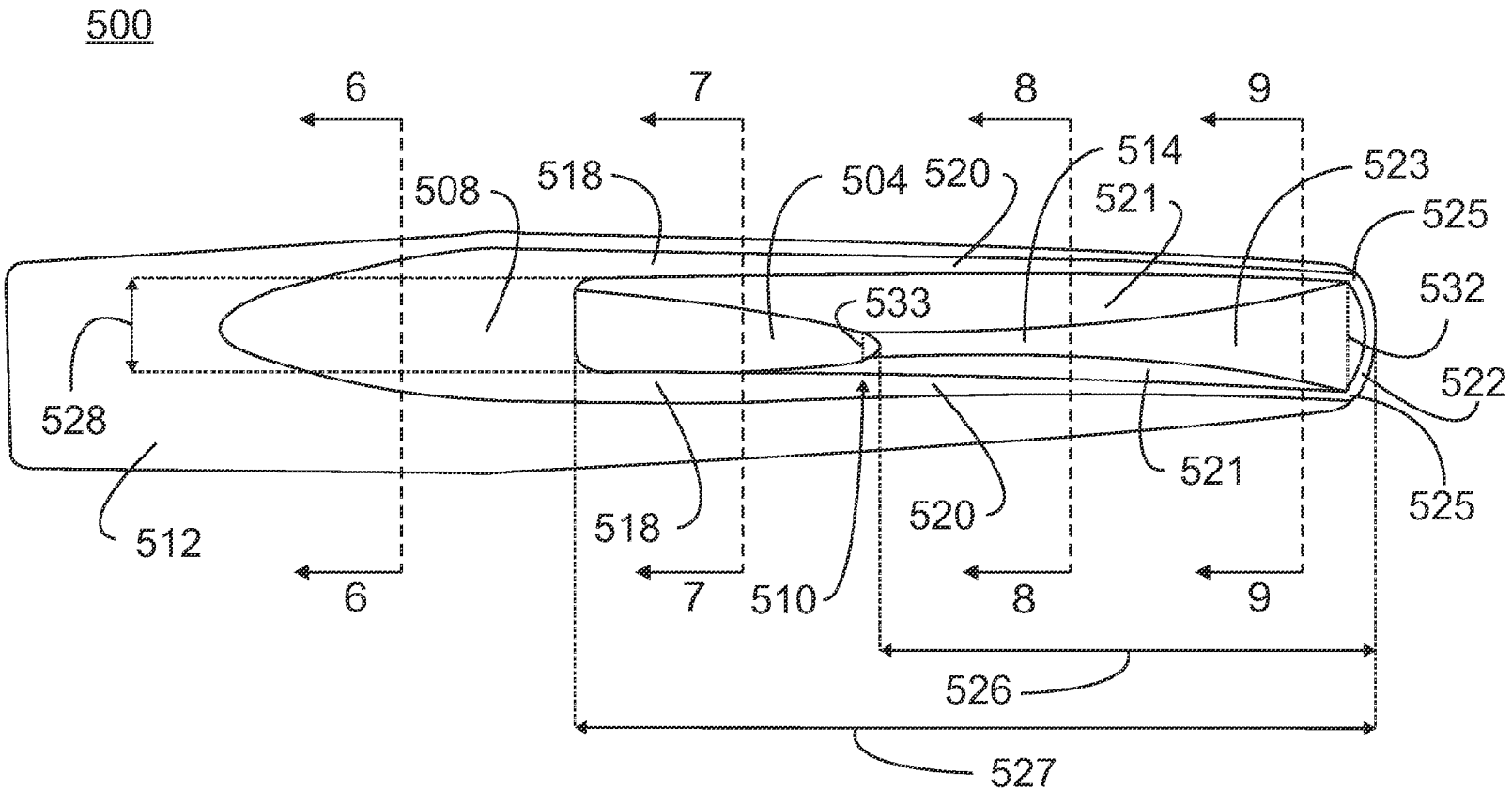
FIG. 5 is a plan view of a bottom side of another embodiment a mouthpiece having a conical tone chamber in accordance with the present invention.
Figure 6:
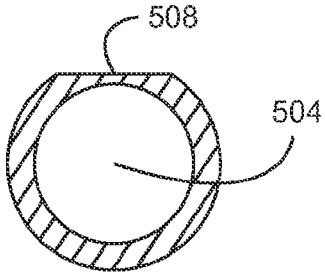
FIG. 6 is a view through line 6-6 of FIG. 5 with the bottom side facing upwards.
Figure 7:
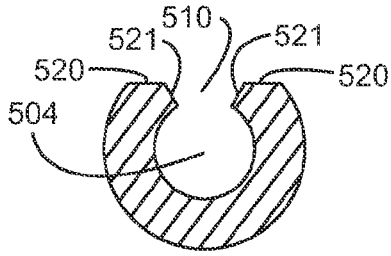
FIG. 7 is a view through line 7-7 of FIG. 5 with the bottom side facing upwards.

As illustrated in FIG. 5, in one embodiment, the bottom surface width includes a first width 532 spanning from the points of intersection 525 of the side rails and the tip rail and a second width 533 at a point of intersection of the tone chamber and the central bore. The ratio of the second width to the first width can be from about 0.8 to about 0.1. Although the width of the bottom surface can vary continuously along its entire length, preferably, the second width begins or is located along the length 526 of the bottom surface at a point between the tip rail and the central bore. For example, this point is measured from the tip rail and is disposed at a distance of from about ¼ to about ½ along the length of the bottom surface. The width of the bottom surface is constant from this point to the central bore, and the second length extends from the point between the tip rail and the central bore through the tone chamber to the central bore. Preferably, the largest width of the bottom surface is adjacent the tip rail.

Varying both the tone chamber width and the bottom surface width creates a tone chamber having a tapered, triangular or conical cross section from side rail to side rail and a tapered, triangular or conical shape from the tip rail to the central bore. Preferably, the wider portion of the conically shaped tone chamber is disposed adjacent the tip rail. The tapered or conical shape of the tone chamber follows the varying width of the tone chamber and bottom surface. Therefore, in one embodiment, the tapered or conical shape extends along the length of the tone chamber and the bottom surface from the tip rail to from about ¼ to about ½ of the length of the bottom surface. Although illustrated as a conical shape, other suitable shapes for the tone chamber include, but are not limited to, hemispherical, tulip shaped, trumpet shaped, elliptical and bi-conical. This produces a tone chamber with sides or side walls that taper or slope when moving from the top to the bottom of the tone chamber as well as when moving from the tip rail to the table, yielding an overall, three-dimensional shape that is generally conically or pyramidal. In general, this yields a shaped-charge type geometry in the tone chamber when viewed from the tip rail. Alternatively, the tone chamber can be formed as a linear shaped charge that has a generally consistent shape or taper along the length of the tone chamber from tip rail to table. In yet another embodiment, combinations of the three-dimensional conical or pyramidal shape and the linear shaped charge arrangement for the tone chamber are provided. For example, a conical arrangement is provided adjacent the tip rail, and this arrangement blends into a linear, triangular or sloped cross-section when moving along the length of the tone chamber from the tip rail.

The present invention is also directed to methods for making or creating a woodwind mouthpiece that takes advantage of the fluid dynamic, hydrodynamic or aerodynamic properties of shaped charges by constructing the mouthpiece and in particular the tone chamber of the mouthpiece as described herein. In one embodiment, a central bore is formed that passes through the mouthpiece. A tone chamber is also formed in the mouthpiece in communication with the central bore. This tone chamber includes a bottom surface and a pair of opposing interior surfaces extending from the bottom surface. A window is formed in the mouthpiece in communication with the tone chamber. This window exposes the tone chamber. The interior surfaces and the bottom surface are formed to create shaped-charge dynamics in an air column within the tone chamber to increase coupling of the air column to a reed covering the window.

In one embodiment, shaping the interior surfaces and the bottom surface includes forming the interior surfaces to create a tapered, triangular or conical cross section and forming the bottom surface to create a tapered, pyramidal or conical shape. In addition, a top rail is formed in the mouthpiece at an end of the tone chamber opposite the central bore, and a wider portion of the tapered or conical shape is formed adjacent the tip rail.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A woodwind mouthpiece comprising:
- a central bore passing through the mouthpiece;
- a tone chamber in communication with the central bore and comprising a bottom surface;
- a window exposing the tone chamber;
- a pair of side rails extending along opposite sides of the window, each side rail comprising a side rail top surface and an interior surface running from the top surface to the bottom surface of the tone chamber;
- a tip rail extending between the side rails, the tone chamber extending from the tip rail to the central bore;
- a tone chamber width defined by a distance between the interior surfaces of the side rails, the tone chamber width greater at the side rail top surface than at the bottom surface of the tone chamber along an entire length of the tone chamber from the tip rail to the central bore; and
- a bottom surface width defined by a distance between the interior surfaces of the side rails at the bottom surface, the bottom surface width greater at an end of the tone chamber adjacent the tip rail than at an end of the tone chamber adjacent the central bore;
- wherein the tone chamber width and the bottom surface width focus energy along their centerlines to increase coupling between an air column in the tone chamber and a reed placed over the window to increase power and to improve intonation in the woodwind mouthpiece.

2. The woodwind mouthpiece of claim 1, wherein the tone chamber width is greater at the side rail top surface than at the bottom surface of the tone chamber along only a portion of an entire length of the tone chamber from the tip rail to the central bore.

3. The woodwind mouthpiece of claim 1, wherein:
- the tone chamber width comprises a first width at points of intersection of the top surfaces and the interior surfaces of the side rails and a second width at a points of intersection of the interior surfaces of the side rails and the bottom surface of the tone chamber; and
- a ratio of the second width to the first width comprises about 0.3.

4. The woodwind mouthpiece of claim 3, wherein the ratio of the second width to the first width varies from about 1 to about 0.3 along a length of the tone chamber from the tip rail to the central bore.

5. The woodwind mouthpiece of claim 4, wherein the ratio of the second width to the first width varies along only a portion of a length of the tone chamber from the tip rail to the central bore.

6. The woodwind mouthpiece of claim 5, wherein the portion of the length comprises from about ¼ to about ½ of the length.

7. The woodwind mouthpiece of claim 1, wherein:
- the bottom surface width comprises a first width at points of intersection of the side rails and the tip rail and a second width at a point of intersection of the tone chamber and the central bore; and
- a ratio of the second width to the first width comprises from about 0.8 to about 0.1.

8. The woodwind mouthpiece of claim 7, wherein the second width extends along a portion of a length of the bottom surface starting at a point between the tip rail and the central bore.

9. The woodwind mouthpiece of claim 8, wherein the point as measured from the tip rail is disposed from about ¼ to about ½ along the length of the bottom surface.

10. The woodwind mouthpiece of claim 1, wherein each top surface and associated interior surface of the side rail meets at an angle of greater than 90°.

11. The woodwind mouthpiece of claim 1, wherein the tone chamber comprises a tapered cross section from side rail to side rail.

12. The woodwind mouthpiece of claim 1, wherein the bottom surface comprises a tapered shape having a wider portion adjacent the tip rail.

13. The woodwind mouthpiece of claim 12, wherein the tapered shape extends along the bottom surface from the tip rail to a point disposed from about ¼ to about ½ along a length of the bottom surface.

14. A woodwind mouthpiece comprising:
- a central bore passing through the mouthpiece;
- a tone chamber in communication with the central bore and comprising a bottom surface;
- a window exposing the tone chamber;
- a pair of side rails extending along opposite sides of the window, each side rail comprising a side rail top surface and an interior surface running from the top surface to the bottom surface of the tone chamber; and
- a tip rail extending between the side rails, the tone chamber extending from the tip rail to the central bore;
- wherein the tone chamber comprises a tapered cross section from side rail to side rail, the bottom surface comprises a tapered shape having a wider portion adjacent the tip rail, the tapered shape extending along the bottom surface from the tip rail to a point disposed from about ¼ to about ½ along a length of the bottom surface, and a width that is constant from that point to the central bore and the tapered cross section and tapered shape focus energy along their centerlines to increase coupling between an air column in the tone chamber and a reed placed over the window to increase power and to improve intonation in the woodwind mouthpiece.

* * * * *